US006329966B1

(12) United States Patent
Someya et al.

(10) Patent No.: US 6,329,966 B1
(45) Date of Patent: Dec. 11, 2001

(54) DISPLAY DEVICE EMPLOYING ULTRAVIOLET-BEAM SCANNING AND COLOR SEPARATOR

(75) Inventors: Jun Someya; Shinsuke Shikama, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/720,964

(22) Filed: Oct. 10, 1996

(30) Foreign Application Priority Data

Oct. 19, 1995 (JP) ..... 7-271576

(51) Int. Cl.[7] ..... G09G 1/28
(52) U.S. Cl. ..... 345/22; 345/32
(58) Field of Search ..... 345/22, 10, 11, 345/20, 150, 32, 36

(56) References Cited

U.S. PATENT DOCUMENTS

| | | | | |
|---|---|---|---|---|
| 3,666,881 | * | 5/1972 | Stein | 178/5.4 |
| 3,703,640 | * | 11/1972 | Broussaud et al. | 250/199 |
| 3,829,838 | * | 8/1974 | Lewis et al. | 340/172.5 |
| 4,150,396 | * | 4/1979 | Hareng et al. | 358/60 |
| 4,213,153 | * | 7/1980 | Schafer | 358/231 |
| 4,295,159 | * | 10/1981 | Carollo et al. | 358/22 |
| 4,312,660 | * | 1/1982 | Blair et al. | 65/85 |
| 4,653,855 | * | 3/1987 | Birnbach et al. | 350/163 |
| 4,934,773 | * | 6/1990 | Becker | 350/6.6 |
| 5,003,179 | * | 3/1991 | Pollack | 250/483.1 |
| 5,260,815 | * | 11/1993 | Takizawa | 359/41 |
| 5,281,960 | * | 1/1994 | Dwyer, III | 345/31 |
| 5,451,980 | * | 9/1995 | Simon et al. | 345/88 |
| 5,504,597 | * | 4/1996 | Sprague et al. | 359/40 |
| 5,526,063 | * | 6/1996 | Joubert et al. | 348/744 |
| 5,537,258 | * | 7/1996 | Yamazaki et al. | 359/634 |
| 5,558,884 | * | 9/1996 | Hug et al. | 425/174.4 |
| 5,617,243 | * | 4/1997 | Yamazaki et al. | 359/309 |
| 5,672,464 | * | 9/1997 | Nelson et al. | 430/327 |
| 5,713,364 | * | 2/1998 | De Baryshe et al. | 128/664 |
| 5,804,919 | * | 9/1998 | Jacobsen et al. | 313/506 |
| 5,875,006 | * | 2/1999 | Nagae et al. | 348/751 |
| 5,903,243 | * | 5/1999 | Jones | 345/7 |
| 5,928,821 | * | 7/1999 | Garrity, Jr. et al. | 430/23 |
| 6,013,400 | * | 1/2000 | La Peruta et al. | 430/24 |

FOREIGN PATENT DOCUMENTS

| | | |
|---|---|---|
| 3-113484 | 5/1991 | (JP) . |
| 4-323686 | 11/1992 | (JP) . |

* cited by examiner

*Primary Examiner*—Bipin Shalwala
*Assistant Examiner*—Vanel Frenel

(57) ABSTRACT

A display device scans a phosphor screen with three independently modulated ultraviolet beams. The screen is coated with three types of light-emitting phosphor dots, each emitting a different color of visible light when illuminated by ultraviolet light. A color separator such as an aperture mask or lens array directs each ultraviolet beam onto phosphor dots of one of these three types. Two or more of these display devices can be combined to obtain a larger screen size.

20 Claims, 6 Drawing Sheets

DISPLAY DEVICE EMPLOYING ULTRAVIOLET-BEAM SCANNING AND COLOR SEPARATOR

BACKGROUND OF THE INVENTION

The present invention relates to a display device that scans a color phosphor screen with a laser beam.

Display devices of this type can display video and other color images similar to those displayed by a conventional cathode-ray tube. The advantage of scanning a color phosphor screen with a laser beam is that a laser beam does not require a large, evacuated glass tube for propagation. Issues must be addressed, however, in these display devices relating to modulating the laser beam and separating of the different colors in the display.

U.S. Pat. No. 5,003,179 describes a display device in which the intensities of three infrared laser beams are independently modulated, the intensity of each beam being selectively blanked to illuminate only phosphors which produce light of the desired color. Such a display device has drawbacks, however, because the need for selectively blanking light beams intensities is inconvenient.

Japanese Patent Kokai Publication No. 323686/1992 describes a display device that modulates the intensity of a single laser beam, which illuminates red, green, and blue phosphors. This system requires that the beam be modulated at three times the normal rate, and is inconsistent with conventional video signal processing.

Japanese Patent Kokai Publication No. 323686/1992 discloses a display device that scans a phosphor screen with a single ultraviolet beam, which is generated by converting the wavelength an infrared laser beam. This system is similarly inconsistent with conventional video signal processing.

SUMMARY OF THE INVENTION

It is accordingly an object of the present invention to display an image by scanning a screen with ultraviolet beams modulated by conventional red, green, and blue video signals.

Another object of the invention is to improve color separation in the displayed image.

A further object is to improve the brightness of the displayed image.

A still further object is to obviate the need for blanking of the ultraviolet beams.

The invented display device has a transparent screen coated with three types of phosphors. When illuminated by ultraviolet light, each type of phosphor emits visible light of a different color. The display device also has a light source for producing three beams of ultraviolet light, three modulating means for independently modulating the intensity of these three ultraviolet beams, a scanning means for scanning the three ultraviolet beams across the transparent screen in a two-dimensional pattern, and a color separator disposed between the scanning means and transparent screen, for directing the three ultraviolet beams onto phosphors of the respective types on the transparent screen.

The light source comprises, for example, three infrared lasers and a wavelength conversion means. The color separator comprises, for example, an aperture mask, or a lens array. The scanning means comprises, for example, a pair of movable mirrors, or a pair of acousto-optic elements.

A filter that transmits ultraviolet light but reflects visible light may be provided between the color separator and the transparent screen to improve the brightness of the display. A focusing lens may also be provided, to focus the three ultraviolet beams.

Two or more of the invented display devices can be combined to form a display apparatus with a larger screen size.

DETAILED DESCRIPTION OF THE INVENTION

Embodiments of the invention will be described with reference to the attached illustrative drawings.

Figure 1:
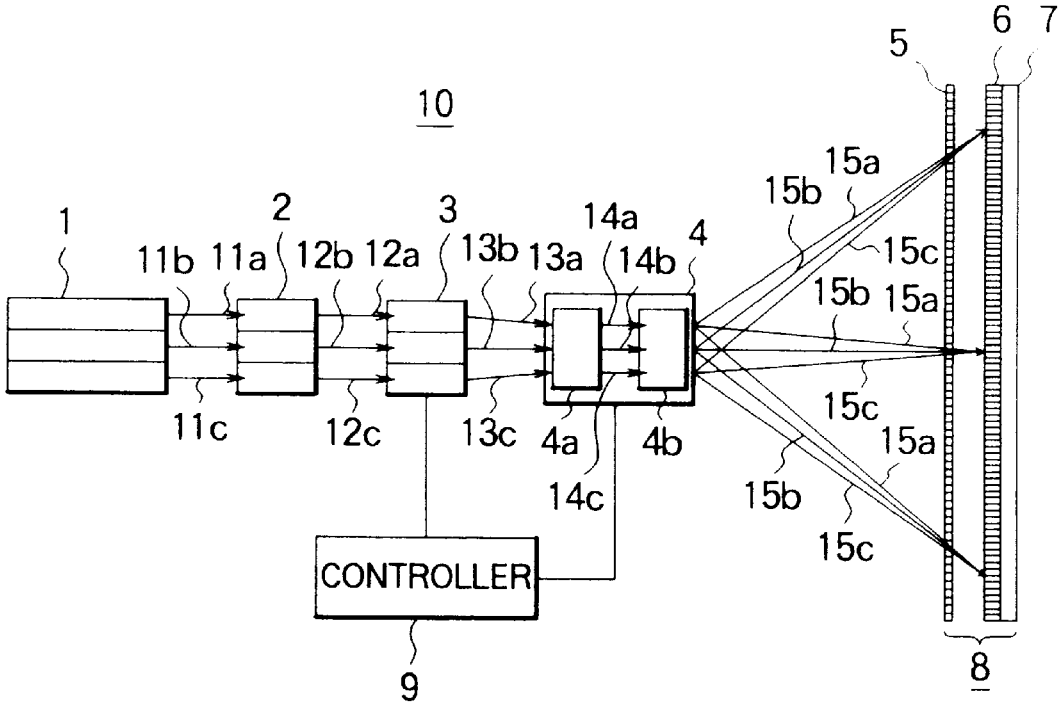
FIG. 1 illustrates a display device according to a first embodiment of the invention.

Referring to FIG. 1, a first embodiment of the invention is a display device 10 comprising three yttrium-aluminum-garnet (YAG) laser light sources 1, three non-linear optical elements 2 such as potassium-titanate-phosphate crystals serving as wavelength conversion means, three acousto-optic modulators 3, a scanning mechanism 4 having a horizontal scanning mirror 4*a* and a vertical scanning mirror 4*b*, an aperture mask 5 serving as a color separator, and a transparent screen 7 with a phosphor coating 6. The aperture mask 5, phosphor coating 6, and transparent screen 7 form a screen assembly 8. The scanning mechanism 4 and acousto-optic modulators 3 are controlled by a controller 9.

Figure 2:
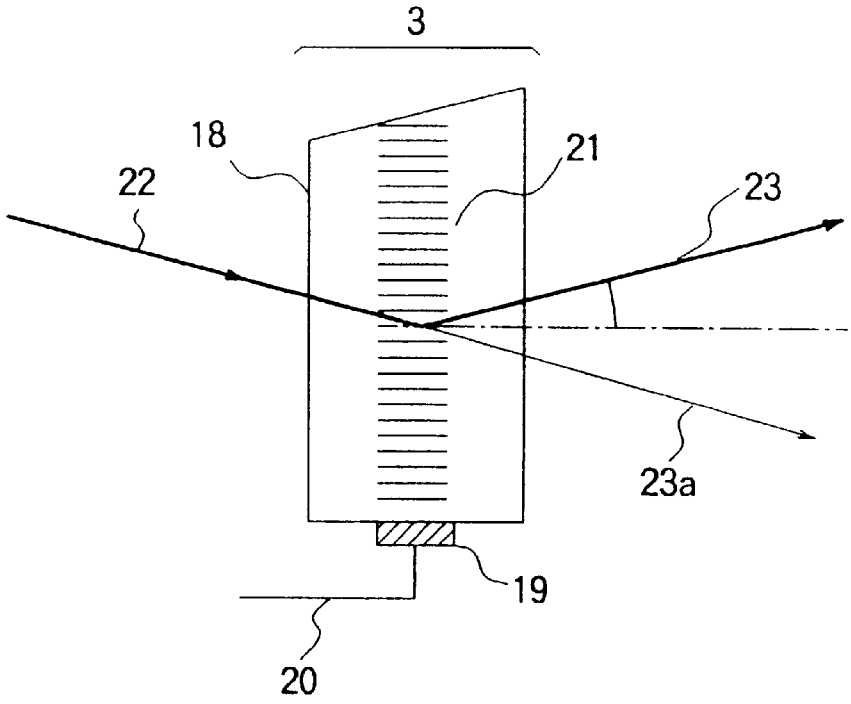
FIG. 2 illustrates an acousto-optic element employed in the scanning means in FIG. 1.

FIG. 2 illustrates the structure of one of the acousto-optic modulators 3 in more detail. This acousto-optic modulator 3 comprises an acoustic medium 18 such as a crystal of tellurium oxide ($TeO_2$) or lead molybdenide ($PbMo_4$), or a glassy material such as fused quartz ($SiO_2$), tellurite glass, or chalcogenide glass, to which an ultrasonic resonator 19 is attached. The ultrasonic resonator 19 is linked to the controller 9 by a signal line 20, and generates ultrasonic waves 21 in the acoustic medium 18 with an intensity controlled by the controller 9. Incident light 22 is partially diffracted by the ultrasonic waves 21, so that a diffracted beam 23 and non-diffracted beam 23*a* emerge.

The operation of the display device 10 can be described as follows.

The three YAG laser light sources 1 emit three coherent beams 11*a*, 11*b*, and 11*c* of infrared light with wavelengths of one thousand sixty-four nanometers (1064 nm). The three non-linear optical elements 2 convert these three coherent beams 11*a,* 11*b,* and 11*c* to three ultraviolet beams 12*a,* 12*b,* and 12*c* with the fourth-harmonic wavelength of two hundred sixty-six nanometers (266 nm). The three acousto-optic modulators 3 independently modulate the intensity of these three ultraviolet beams 12*a,* 12*b,* and 12*c* according to red, green, and blue video signals received from the controller 9 to produce three modulated beams 13*a,* 13*b,* and 13*c.*

In each acousto-optic modulator, the appropriate video signal is supplied through the signal line 20 to the resonator 19 in FIG. 2, and controls the intensity of the ultrasonic waves 21. The intensity of the ultrasonic waves 21 in turn controls the amount of ultraviolet light that is diffracted, thus determining the intensity of the diffracted beam 23. The diffracted beam 23 in FIG. 2 is one of the three modulated beams 13*a,* 13*b,* and 13*c* in FIG. 1, while the incident beam 22 is one of the three ultraviolet beams 12*a,* 12*b,* and 12*c.*

In the scanning mechanism 4, the horizontal scanning mirror 4*a* deflects the three modulated beams 13*a,* 13*b,* and 13*c* horizontally in response to a horizontal drive signal from the controller 9. The resulting horizontally scanned beams 14*a,* 14*b,* and 14*c* are then scanned vertically by the vertical scanning mirror 4*b* in response to a vertical drive signal from the controller 9. The horizontal scanning mirror 4*a* is, for example, a polygon mirror. The vertical scanning mirror 4*b* is, for example, a galvano-mirror. The scanning mechanism 4 thus produces three ultraviolet beams 15*a,* 15*b,* and 15*c* that are scanned horizontally and vertically in a two-dimensional pattern. FIG. 1 shows these three ultraviolet beams 15*a,* 15*b,* and 15*c* in three different scanning positions.

Figure 3:
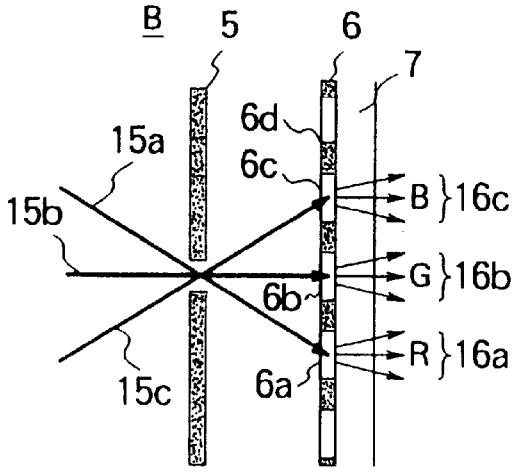
FIG. 3 illustrates the aperture mask, phosphor coating, and transparent screen in FIG. 1.

FIG. 3 illustrates the detailed structure and operation of the aperture mask 5 and the phosphor coating 6 on the transparent screen 7. The phosphor coating 6 comprises red phosphor dots 6*a,* green phosphor dots 6*b,* and blue phosphor dots 6*c* separated by a black matrix 6*d.* The apertures in the aperture mask 5 are positioned so that ultraviolet beam 15*a* illuminates only red phosphor dots 6*a,* ultraviolet beam 15*b* illuminates only green phosphor dots 6*b,* and ultraviolet beam 15*c* illuminates only blue phosphor dots 6*c.* When illuminated, a red phosphor dot 6*a* emits red light 16*a,* a green phosphor dot 6*b* emits green light 16*b,* and a blue phosphor dot 6*c* emits blue light 16*c.*

An ultraviolet sensor (not visible in FIG. 1) is disposed between the scanning mechanism 4 and the screen assembly 8, at a point that does not interfere with the display. When the ultraviolet beams 15*a,* 15*b,* and 15*c* illuminate this sensor, a signal is returned to the controller 9, which thereby learns the position of the beams. This signal enables the controller 9 to synchronize the operation of the scanning mechanism 4 with the red, green, and blue video signals supplied to the acousto-optic modulators 3. This ultraviolet sensor is similar to a well-known sensor used for a similar purpose in laser printers.

If necessary, a plurality of ultraviolet sensors can be provided. Separate sensors can be provided for horizontal scanning and vertical scanning, for example.

As the above description shows, the phosphor screen 6, like the screen of a conventional color television set, is scanned by three independently modulated beams. These three beams can be modulated by conventional red, green, and blue video signals, and a conventional scanning sequence can be employed. Because of the aperture mask 5, there is no need to blank the beams to avoid having them illuminate the wrong phosphor dots.

The apertures in the aperture mask 5 may be round, or may have the form of oblong slots. Similarly, the phosphor dots in the phosphor coating 6 may be either round or oblong in shape.

Next a second embodiment will be described. The second embodiment is identical to the first embodiment except that the color separation means is a lens array, instead of an aperture mask. The description of the second embodiment will be confined to the structure and operation of the lens array.

Figure 4:
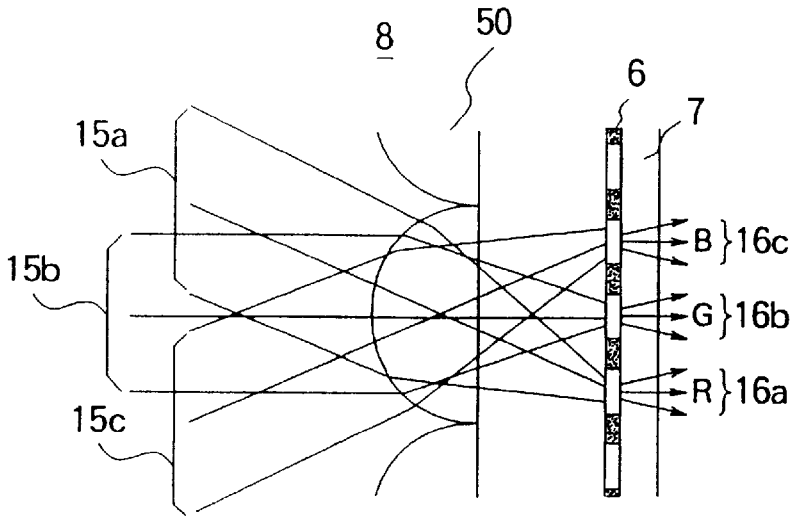
FIG. 4 illustrates a lens array in a display device according to a second embodiment of the invention.

Referring to FIG. 4, the lens array 50 comprises a plurality of microlenses disposed in positions corresponding to the apertures in the aperture mask 5 of the first embodiment. As the drawing shows, these microlenses focus the ultraviolet beams 15*a,* 15*b,* and 15*c* onto phosphors of the respective types that emit red light 16*a,* green light 16*b,* and blue light 16*c.* The same color-separating effect is obtained as in the first embodiment, with the added advantage that all of the light in the ultraviolet beams 15*a,* 15*b,* and 15*c* is directed onto the phosphor coating 6, so a brighter display is obtained.

The lenses in the lens array may be round, or may have an oblong shape or any other suitable shape.

Next a third embodiment will be described. The third embodiment differs from the first embodiment only in the structure of the screen assembly 8, so the description will be confined to this point.

Figure 5:
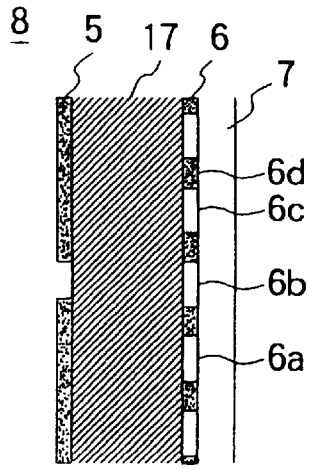
FIG. 5 illustrates the screen assembly in a display device according to a third embodiment of the invention.

Referring to FIG. 5, the screen assembly 8 in the third embodiment has the same aperture mask 5, transparent screen 7, and phosphor coating 6 as in the first embodiment, and also has a transparent plate 17 disposed between the aperture mask 5 and phosphor coating 6. The transparent plate 17 supports the aperture mask 5 and maintains an exact positional relationship between the aperture mask 5 and phosphor coating 6. This ensures accurate color separation.

The third embodiment can also simplify the fabrication of the aperture mask 5. The aperture mask 5 can be formed by evaporation deposition or printing of an opaque substance on the transparent plate 17.

Figure 6:
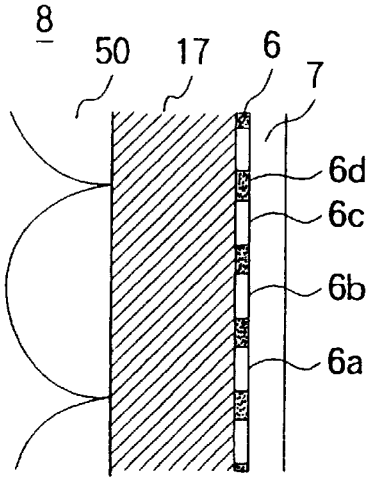
FIG. 6 illustrates the screen assembly in a display device according to a fourth embodiment of the invention.

Next a fourth embodiment will be briefly described. Referring to FIG. 6, the fourth embodiment combines the features of the second and third embodiments, having a lens array 50 supported on a transparent plate 17. The lens array 50 and transparent plate 17 may be combined into a single structure, by processing the surface of the transparent plate 17 to form an array of lenses.

Next, a fifth embodiment will be described.

Figure 7:
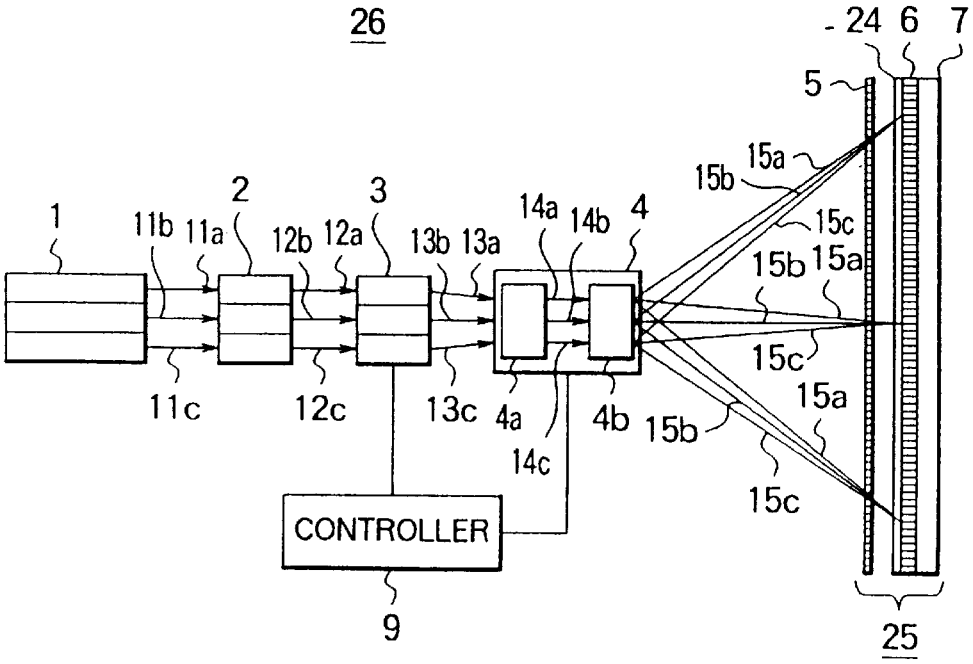
FIG. 7 illustrates a display device according to a fifth embodiment of the invention.

FIG. 7 shows a display device 26 according to the fifth embodiment, using the same reference numerals as in FIG. 1 for elements that are the same as in the first embodiment. The fifth embodiment differs from the first embodiment only in the structure of the screen assembly 25. The fifth embodiment provides a filter 24 between the aperture mask 5 and phosphor coating 6. This filter 24 transmits ultraviolet light, but reflects visible light.

Figure 8:
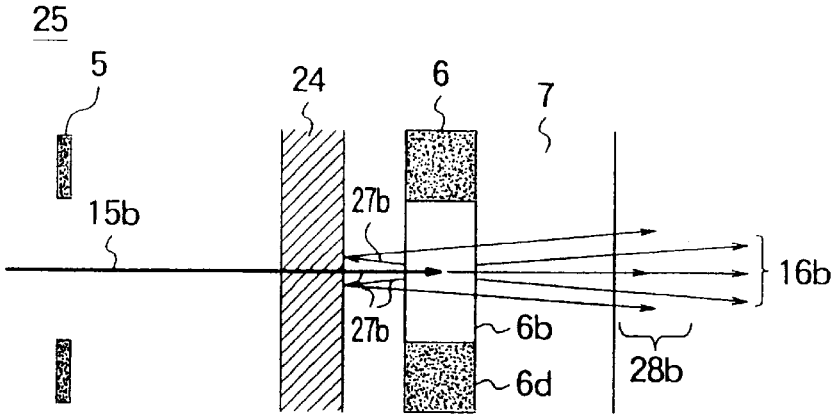
FIG. 8 illustrates the screen assembly in the fifth embodiment.

FIG. 8 illustrates the operation of the filter 24 in the fifth embodiment. Ultraviolet beam 15*b* passes through an aperture in the aperture mask 5, passes through the filter 24, and illuminates a green phosphor dot 6*b.* The phosphor dot 6*b* emits green light, with an intensity responsive to the intensity of the ultraviolet beam 15*b,* but the light is emitted in all directions. Green light 27*b* emitted toward the filter 24 is reflected back, and the reflected green light 28*b* passes through the transparent screen 7 to enhance the intensity of the light 16*b* emitted directly through the transparent screen 7.

Red and blue light are similarly reflected from the filter 24, which thus improves the overall brightness of the display.

For clarity, FIG. 8 shows a gap between the filter 24 and phosphor coating 26, but the filter 24 may be disposed in contact with the phosphor coating 6.

The fifth embodiment can be combined with the second, third, or fourth embodiment, by employing a lens array 50 instead of an aperture mask 5, and/or by adding a transparent plate between the filter 24 and the aperture array 5 or lens array 50.

Next a sixth embodiment will be described.

Figure 9:
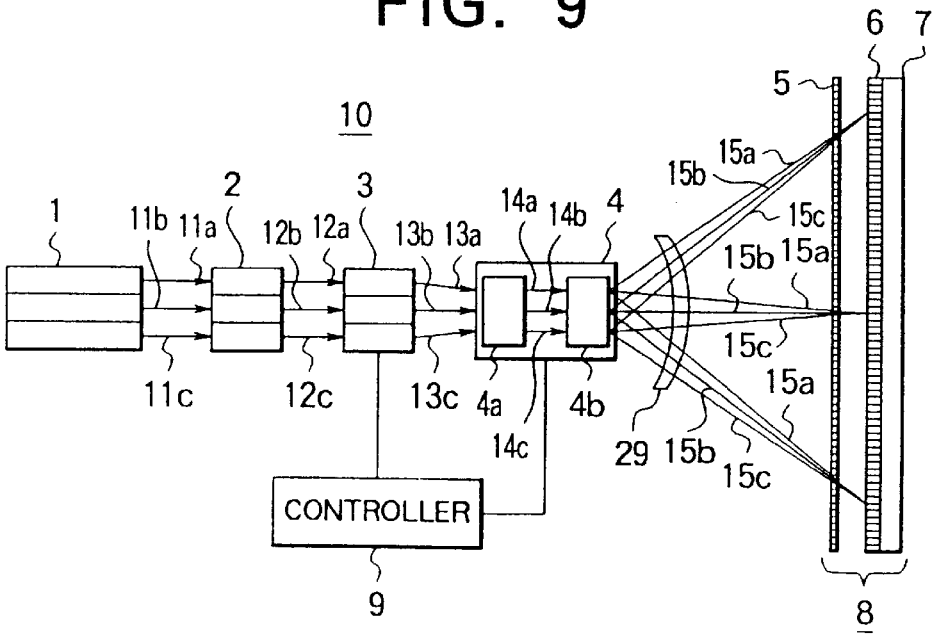
FIG. 9 illustrates a display device according to a sixth embodiment of the invention.

FIG. 9 illustrates the sixth embodiment, using the same reference numerals as in FIG. 1 for elements that are the same as in the first embodiment. To the structure of the first embodiment, the sixth embodiment adds a focusing lens 29 made, for example, of fused quartz. This focusing lens 29 focuses the ultraviolet beams 15*a,* 15*b,* and 15*c* to points on the phosphor coating 6, thereby increasing the amount of light that gets through the aperture mask 5 and enhancing the brightness of the display.

The focusing lens 29 in FIG. 9 is shown as a simple meniscus lens, but a compound lens may be used instead. The lens material is not restricted to fused quartz; any material capable of focusing ultraviolet light may be used.

The focusing lens 29 need not be disposed between the scanning mechanism 4 and screen assembly 8; other locations are possible. For example, the focusing lens 29 may be disposed between the horizontal scanning mirror 4*a* and vertical scanning mirror 4*b*. Alternatively, a first focusing lens may be provided between the horizontal scanning mirror 4*a* and vertical scanning mirror 4*b,* and a second lens may be provided between the vertical scanning mirror 4*b* and the screen assembly 8.

The sixth embodiment can be combined with the second, third, fourth, or fifth embodiment, by adding a similar focusing lines 29 to any of those embodiments.

Figure 10:
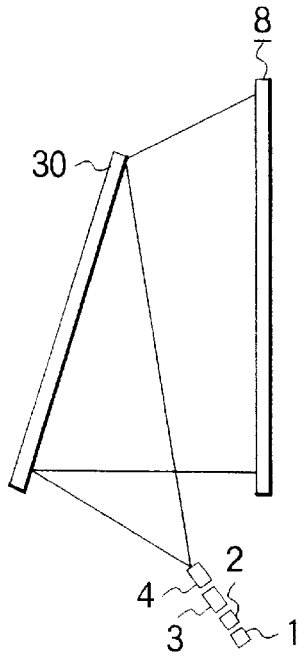
FIG. 10 illustrates a display device according to a seventh embodiment of the invention.

Next, a seventh embodiment will be briefly described. Referring to FIG. 10, the seventh embodiment has infrared laser light sources 1, non-linear optical elements 2 for wavelength conversion, acousto-optic modulators 3, a scanning mechanism 4, and a screen assembly 8 as in the first embodiment, and a reflecting plate 30. The reflecting plate 30 reflects the ultraviolet beams output from the scanning means, thereby directing the ultraviolet beams onto the screen assembly 8. In this way, the back-to-front length of the display device is reduced, as compared with the preceding embodiments.

The seventh embodiment is not limited to a single reflecting plate 30. Two or more reflecting plates may be provided, allowing a long Light path to be obtained in a confined space.

The reflecting plate 30 of the seventh embodiment can be used in combination with any of the preceding six embodiments.

Figure 11:
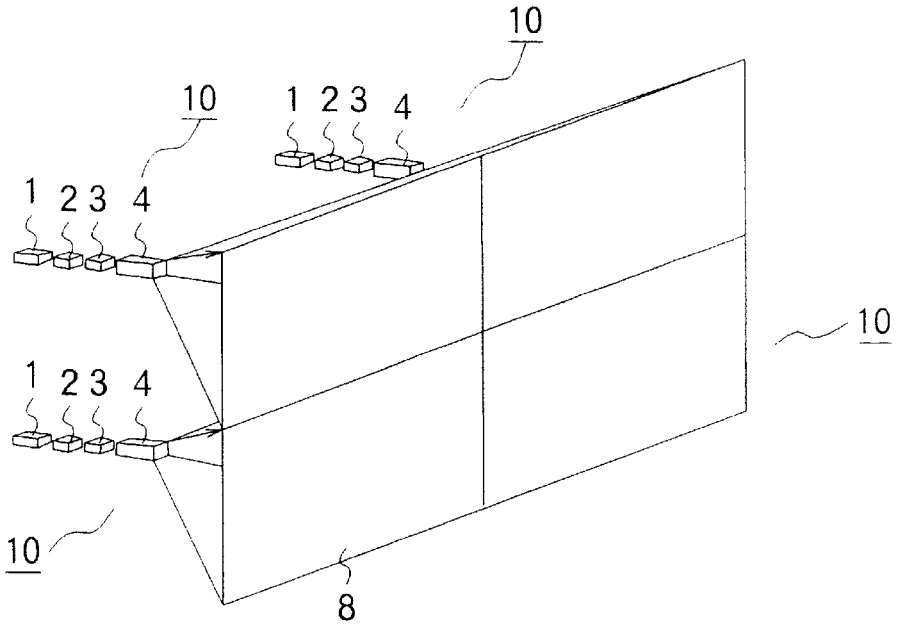
FIG. 11 illustrates a display apparatus according to an eighth embodiment of the invention.

Next, an eighth embodiment will be briefly described. Referring to FIG. 11, the eighth embodiment is a display apparatus employing four of the display devices 10 of the first embodiment. Each of these display devices 10 has its own infrared laser light sources 1, non-linear optical elements 2, acousto-optic modulators 3, scanning mechanism 4, and screen assembly 8. Compared with the first embodiment, the eighth embodiment doubles the height, width, and resolution of the display.

The eighth embodiment is not limited to a combination of four display devices 10. Any number of display devices may be combined in a similar manner, to form a display screen of any desired size.

The screen assemblies 8 in FIG. 11 may abut directly against one another to form a large, continuous display area, an arrangement which would be impossible with conventional cathode-ray tubes. Alternatively, the screen assemblies 8 can be held in a supporting framework, like the panes of glass in a window. The display devices 10 may be housed in a single cabinet, or in separate cabinets.

The display devices are not restricted to the display devices 10 of the first embodiment. Display devices as described in any of the other preceding embodiments can be similarly combined.

The invention is not restricted to the embodiments above. Further variations are possible, such as the following.

The modulating means need not be acousto-optic modulators as described in the embodiments above. Optical intensity modulators employing electro-optic elements, for example, are well known, and may be used instead of acoustic modulators.

The scanning mechanism 4 may be replaced by an acousto-optic scanning means, employing acousto-optic elements of the same type as shown in FIG. 2. Scanning can be accomplished by varying the frequency at which the ultrasonic resonator 19 is driven, thus varying the angle at which the ultraviolet beams are diffracted. This acousto-optic scanning method has the advantage of eliminating moving mirrors and other moving parts.

The scanning mechanism 4 may also be replaced by an electro-optic scanning means using prisms with refractive indices that vary in response to an applied voltage.

The embodiments above produced ultraviolet beams by wavelength conversion of infrared light, but the invention can also be practiced with ultraviolet light sources, in which case wavelength conversion is unnecessary.

Those skilled in the art will recognize that still further variations are possible within the scope claimed below.

What is claimed is:

1. A display device, comprising:

a transparent screen coated with three types of phosphors, for emitting visible light of three corresponding colors when illuminated by ultraviolet light;

a light source for producing three beams of ultraviolet light;

three modulators, each for modulating an intensity of a corresponding ultraviolet beam;

a scanner for scanning said ultraviolet beams across said transparent screen in a two-dimensional pattern; and a color separator disposed between said scanner and said transparent screen, for directing said three ultraviolet beams onto corresponding phosphor types on said transparent screen.

2. The display device of claim 1, wherein said light source comprises:

three laser light sources for producing three coherent light beams; and three wavelength converters for converting said coherent light beams to ultraviolet beams.

3. The display device of claim 1, wherein said color separator comprises:

an aperture mask having apertures disposed so that each of said ultraviolet beams, after passing through said apertures, illuminates phosphors of just one of said three types.

4. The display device of claim 1, wherein said color separator comprises:

an array of lenses for focusing said ultraviolet beams so that each of said ultraviolet beams, after passing through said array of lenses, illuminates phosphors of just one of said three types.

5. The display device of claim 1, wherein said color separator is mounted on a transparent substrate.

6. The display device of claim 1, wherein said scanner has a first mirror for scanning said ultraviolet beams horizontally, and a second mirror for scanning said ultraviolet beams vertically.

7. The display device of claim 1, wherein said scanner has a first acousto-optic element for scanning said ultraviolet beams horizontally, and a second acousto-optic element for scanning said ultraviolet beams vertically.

8. The display device of claim 1, further comprising:

a filter disposed between said color separator and said transparent screen, for transmitting ultraviolet light and reflecting visible light.

9. The display device of claim 1, further comprising:

a focusing lens disposed between said scanner and said transparent screen, for focusing said ultraviolet beams onto said screen.

10. The display device of claim 1, further comprising:

a reflecting plate for reflecting said ultraviolet beams onto said transparent screen after said ultraviolet beams have been scanned by said scanner.

11. A compound display apparatus comprising a plurality of display devices disposed in a two-dimensional array, each of said display devices having:

a transparent screen coated with three types of phosphors, for emitting visible light of three corresponding colors when illuminated by ultraviolet light;

a light source for producing three beams of ultraviolet light;

three modulators, each for modulating an intensity of a corresponding ultraviolet beam;

a scanner for scanning said ultraviolet beams across said transparent screen in a two-dimensional pattern; and a color separator disposed between said scanner and said transparent screen, for directing said three ultraviolet beams onto corresponding phosphor types on said transparent screen.

12. The display apparatus of claim 11, wherein each said light source comprises:

three laser light sources for producing three coherent light beams; and three wavelength converters for converting said coherent light beams to ultraviolet beams.

13. The display apparatus of claim 11, wherein each said color separator comprises:

an aperture mask having apertures disposed so that each of said ultraviolet beams, after passing through said apertures, illuminates phosphors of just one of said three types.

14. The display apparatus of claim 11, wherein each said color separator comprises:

an array of lenses for focusing said ultraviolet beams so that each of said ultraviolet beams, after passing through said array of lenses, illuminates phosphors of just one of said three types.

15. The display apparatus of claim 11, wherein each said color separator is mounted on a transparent substrate.

16. The display apparatus of claim 11, wherein each said scanner has a first mirror for scanning said ultraviolet beams horizontally, and a second mirror for scanning said ultraviolet beams vertically.

17. The display apparatus of claim 11, wherein each said scanner has a first acousto-optic element for scanning said ultraviolet beams horizontally, and a second acousto-optic element for scanning said ultraviolet beams vertically.

18. The display apparatus of claim 11, each said display device further having:

a filter disposed between said color separator and said transparent screen, for transmitting ultraviolet light and reflecting visible light.

19. The display apparatus of claim 11, each said display device further having:

a focusing lens disposed between said scanner and said transparent screen, for focusing said ultraviolet beams onto said screen.

20. The display apparatus of claim 11, further comprising:

at least one reflecting plate for reflecting said ultraviolet beams onto the transparent screen of each of said plurality of display devices after said ultraviolet beams have been scanned by said scanner.

* * * * *